US007652647B2

(12) United States Patent
Kageyama et al.

(10) Patent No.: US 7,652,647 B2
(45) Date of Patent: Jan. 26, 2010

(54) IMAGE DISPLAY DEVICE

(75) Inventors: Hiroshi Kageyama, Hachioji (JP); Hajime Akimoto, Kokubunji (JP)

(73) Assignee: Hitachi Displays, Ltd., Chiba (JP)

( * ) Notice: Subject to any disclaimer, the term of this patent is extended or adjusted under 35 U.S.C. 154(b) by 815 days.

(21) Appl. No.: 11/242,039

(22) Filed: Oct. 4, 2005

(65) Prior Publication Data

US 2006/0077195 A1 Apr. 13, 2006

(30) Foreign Application Priority Data

Oct. 8, 2004 (JP) ..... 2004-295637

(51) Int. Cl.
*G09G 3/32* (2006.01)

(52) U.S. Cl. ..... 345/82; 345/204; 345/205; 345/206

(58) Field of Classification Search ..... 345/82, 345/87, 90, 92, 100, 103, 204, 205, 206
See application file for complete search history.

(56) References Cited

U.S. PATENT DOCUMENTS 6,229,508 B1 * 5/2001 Kane ..... 345/82

2005/0104822 A1 * 5/2005 Seki ..... 345/82

FOREIGN PATENT DOCUMENTS

JP 2003-122301 10/2001

* cited by examiner

*Primary Examiner*—Richard Hjerpe
*Assistant Examiner*—Saifeldin Elnafia
(74) *Attorney, Agent, or Firm*—Stites & Harbison PLLC; Juan Carlos A. Marquez, Esq.

(57) ABSTRACT

Improvement is to be achieved against poor image quality attributable to voltage drops on wirings, and the image quality especially of large image display devices is to be ameliorated. The circuit configuration comprises a scanning circuit for controlling a plurality of pixel circuits; a plurality of scanning wirings for conveying the signals of the scanning circuit to the pixel circuits; a plurality of first and second wirings for supplying image signals and power to the pixel circuits, arranged in parallel to each other and crossing said scanning wirings; and a drive circuit for supplying image signals and power to the first and second wirings; all disposed over a glass substrate, wherein the drive circuit supplies power to both first and second wirings when the light-emitting devices emit light in response to image signals.

3 Claims, 14 Drawing Sheets

IMAGE DISPLAY DEVICE

CLAIM OF PRIORITY

The present application claims priority from Japanese application JP 2004-295637, filed on Oct. 8, 2004, the content of which is hereby incorporated by reference into this application.

FIELD OF THE INVENTION

The present invention relates to a light-emitting type image display device.

BACKGROUND OF THE INVENTION

As an image display device using light-emitting devices for pixels, an EL display using electroluminescence (hereinafter abbreviated to EL) elements is known. In an active matrix type EL display, wiring for conveying signals and electric currents is arranged in a matrix form, and each pixel has a built-in pixel circuit formed of a thin film transistor (hereinafter abbreviated to TFT), which is an active element, in addition to an EL element. The brightness of the EL element is controlled by regulating the current supplied to the EL element. A method for the pixel circuit to control the current is disclosed in, for instance, Patent Document 1. As an EL element whose brightness varies with the amperage, an organic EL diode is known.

FIG. 13 shows an example of configuration of a conventional image display device using EL elements. Over the surface of a glass substrate 91, an image display area 92 and a scanning circuit 94 are formed. In the image display area 92, a plurality of pixel circuits 95, a plurality of reset signal lines 96, a plurality of lighting signal lines 97, signal lines SL and power supply line PL are arranged in a matrix form. Each reset signal line 96 is connected to the reset signal inputs r of the pixel circuits 95 for one row, and each lighting signal lines 97, to the lighting signal inputs i of the pixel circuits 95 for one row. Each of the reset signal lines 96 and each of the lighting signal lines 97 serve to convey the output signals of the scanning circuit 94 to the pixel circuits 95 for one row. Each signal line SL is connected to the image signal inputs S of the pixel circuits 95 for one column, and each power supply line PL, to the power supply inputs P of the pixel circuits 95 for one column.

A driver IC 93 is bonded over the glass substrate 91 by pressure bonding. The driver IC 93 has a function to convert digital image signals serially received from outside into voltage signals and supply them to outputs D(1) through D(x). A power supply bus 98, connected to every one of the power supply lines PL, supplies a power voltage VDDex received from outside. The scanning circuit 94, which is a logic circuit formed of a TFT, has a function to drive every one of the reset signal lines 96 and the lighting signal lines 97.

The configuration of the pixel circuit 95 is the same as that of a pixel circuit 5 used in an embodiment of the present invention to be described later. As the detailed configuration and operation of the pixel circuit 5 will be described with reference to the embodiment, the operation of the pixel circuit 95 will not be described in detail here but only briefly.

Writing into a pixel circuit 95 causes the voltage of sum (Vdata+Vth) of a signal voltage Vdata and the absolute value Vth of the threshold voltage of a TFT 21 to be stored into a capacitor 24. When an image is to be displayed, the image signal inputs S to the pixel circuits are kept constant and a TFT 23 is turned on. Then, the voltage (Vdata+Vth) is generated between the gate and source of the TFT 21, to cause a current to flow into an EL element 25. As the amperage of the current flowing into the EL element 25 is controlled with the image signal voltage Vdata, the pixel circuit 95 can control the brightness of the EL element 25. By varying the image signal voltage Vdata to be written into each pixel circuit 95 according to the image, the intended image can be displayed.

Patent Document 1: Japanese Patent Laid-Open No. 2003-122301

SUMMARY OF THE INVENTION

Referring to FIG. 13, when an image is displayed (lit mode), as the EL element 25 in each pixel circuit 95 is lit, a large current flows on the power supply line PL. Then the resistance of the power supply line PL brings down the voltage. FIG. 14 shows the voltage drop on the power supply line PL and the signal line SL, the voltage of a node a in the pixel circuit 95 connected to them, and the gate/source voltages Vgs (#1) through Vgs (#n) of the TFT 21. The horizontal axis represents the longitudinal direction of the direction (direction y) and the vertical axis, the voltage. It has to be noted, though, that FIG. 14 supposes the voltages Vdata to be equal among all the pixel circuits (the image display device to be lit at constant and uniform brightness) for the sake of making the graphic expression easier to be understood. The power supply line PL is connected to the power supply inputs P of the pixel circuits 95 for one column. For this reason, when the EL elements 25 are lit, a voltage drop Vdrop occurs on the power supply line PL. With an advance in the direction y, the voltage on the power supply line PL further drops. On the other hand, the signal line SL is connected to the image signal inputs S to the pixel circuits 95 for one column.

Since no current flows on the signal lines SL, no voltage drop occurs on the signal line SL. The gate/source voltage of the TFT 21 in the pixel circuit 95 of the first row is Vgs (#1)=(VDDex)−(VDDex−data−Vth)=Vth+Vdata. On the other hand, the gate/source voltage of the TFT 21 in the pixel circuit 95 on the n-th row is Vgs (#n)=(VDDex−Vdrop)−(VDDex−Vdata−Vth)=Vth+Vdata−Vdrop. Thus, with an advance in the direction y, the absolute value of the gate/source voltage of the TFT 21 lowers as much as Vdrop. Therefore, as the current flowing into the EL elements 25 decreases with an advance in the direction y, brightness differs between the upper and lower parts of the frame, resulting in poor image quality.

Further, when a black rectangle BK (shaded for the sake of convenience) is shown against a white background in the image display area 92 as shown in FIG. 15, the voltage drop Vdrop on the power supply wiring of line K is less than that on the power supply wiring of line J, area k will become luminescent more brightly than area j. As a result, discontinuity in brightness arises in the positions of line q and line q'. An observer noticing this phenomenon would perceive a kind of poor image quality known as smear. Especially for a larger image display device, longer wiring invites a greater resistance, and accordingly the perceived poor image quality will be more conspicuous.

An object of the present invention, therefore, is to provide an image display device improved in respect of poor image quality attributable to a voltage drop on power supply wiring as described above.

According to a typical aspect of the present invention disclosed in this specification, an image display device according to the invention in which a plurality of pixel circuits each comprising a light-emitting device and a circuit element for controlling the light-emission intensity of the light-emitting device are arranged in a matrix form over a substrate, further includes a scanning circuit for controlling the operation of the plurality of pixel circuits; a plurality of scanning wirings for conveying signals of the scanning circuit to the plurality of pixel circuits; a plurality of first wirings and a plurality of second wirings for supplying image signals and power to the plurality of pixel circuits, arranged in parallel to each other and crossing the scanning wirings; and a drive circuit for supplying image signals and power to the first wirings and the second wirings, wherein power is supplied by the drive circuit to both the first wirings and the second wirings when the light-emitting device emits light in response to the image signals.

DETAILED DESCRIPTION OF THE PREFERRED EMBODIMENTS

Image display devices, which are preferred embodiments of the present invention will be described in detail below with reference to accompanying drawings.

First Embodiment

Figure 1:
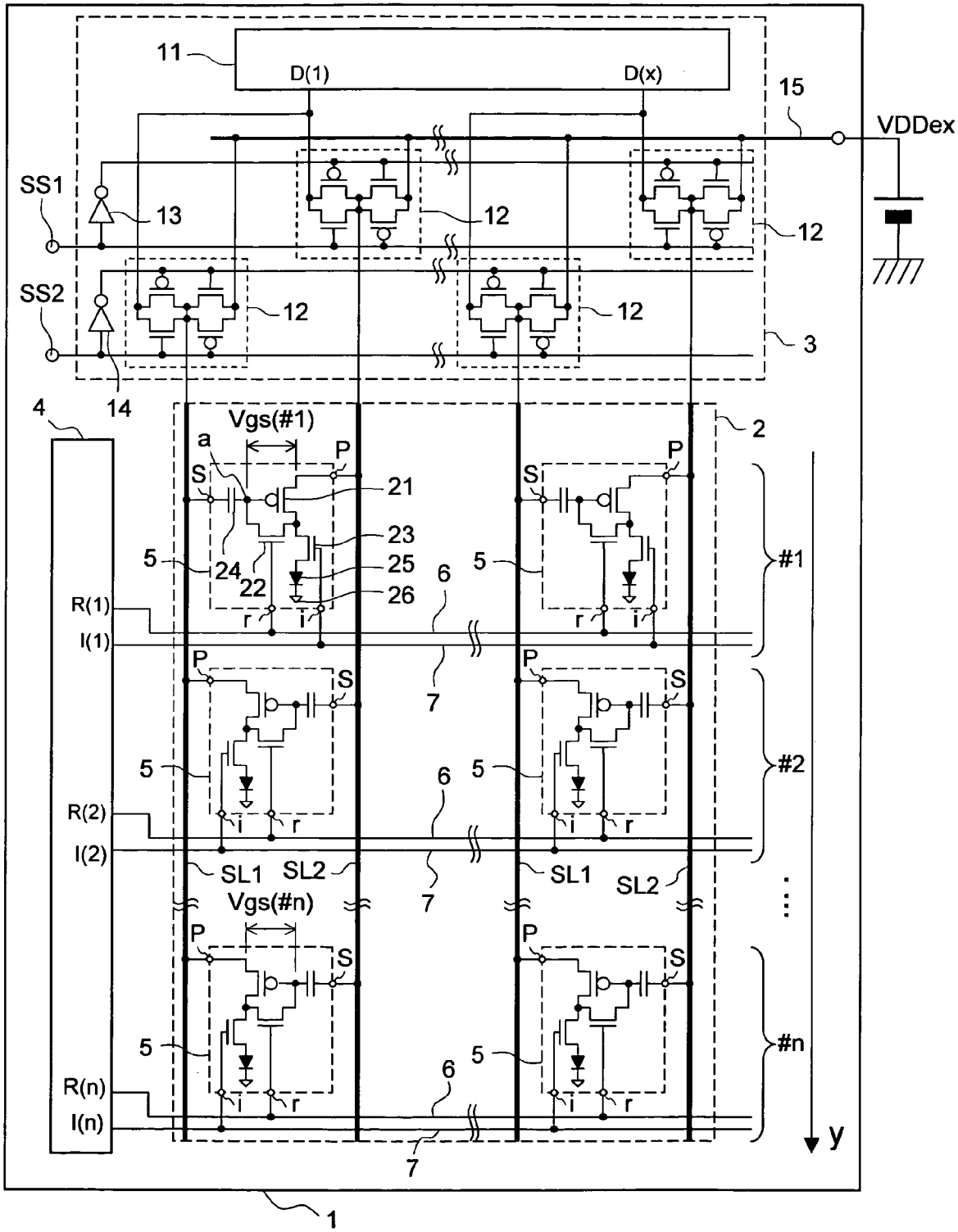
FIG. 1 shows the configuration of an image display device, which is a first preferred embodiment of the present invention.

FIG. 1 shows the configuration of an image display device, which is a first preferred embodiment of the invention. An image display area 2, a drive circuit 3 and a scanning circuit 4 are formed over the surface of a glass substrate 1. In the image display area 2, a plurality of pixel circuits 5, a plurality of reset signal lines 6, a plurality of lighting signal lines 7 and a plurality of wirings SL1 and SL2 are arranged in a matrix form. The reset signal lines 6 are connected to the reset signal input r of the pixel circuits 5 for one row, and the lighting signal lines 7, to the lighting signal inputs i of the pixel circuits 5 for one row. The reset signal lines 6 and the lighting signal lines 7 serve to convey the output signals of the scanning circuit 4 to the pixel circuits 5 for one row. The wirings SL1 and SL2 are connected to the image signal inputs S and the power supply inputs P of the pixel circuits 5 for one column.

However, for the pixel circuits 5 on odd number lines (#1, #3, . . . ), the image signal inputs S are connected to the wiring SL1, and the power supply inputs P are connected to the wiring SL2. For the pixel circuits 5 on even number lines (#2, #4, . . . ), the image signal inputs S to the wiring SL2 and the power supply inputs P to the wiring SL1. It is only for the convenience of description that the number of the pixel circuits 5 is supposed to be 2 columns×3 rows=6, those of the reset signal lines and lighting signal lines, three each, and those of the wirings SL1 and SL2, two each. If the resolution of the screen conforms to that of color Video Graphic Array (VGA) for instance, the number of columns and that of rows of the pixel circuits 5 will be 1920 and 480, respectively, and those of the reset signal lines and the lighting signal lines will be 480, and those of the wirings SL1 and SL2 will be 1920 each.

The drive circuit 3 comprises a driver IC 11 stuck to the glass substrate 1 by pressure bonding, a selection switch circuit 12, inverters 13 and 14, and a power supply bus 15. The selection switch circuit 12 and the inverters 13 and 14 are formed of TFTs. The driver IC 11 has a function to convert digital image signals received serially from outside into voltage signals and supplies them to the outputs D(1) through D(x). The power supply bus 15 is supplied with a power voltage VDDex from outside. The selection switch circuit 12 has a function to select either the output voltage signal of the driver IC 11 or the power voltage VDDex of the power supply bus 15. The inverters 13 and 14 have a function to subject switching signals SS1 and SS2 for the selection switch circuit 12 received from outside to logical inversion. The scanning circuit 4, which is a logical circuit formed of a TFT, has a function to drive all the reset signal wiring 6 and the lighting signal lines 7.

A pixel circuit 5 comprises a P-channel TFT 21 and N-channel TFTs 22 and 23, a capacitor 24 and an EL element 25. The pixel circuit 5 is connected to external circuits through an image signal input S, a power supply input P, a reset signal input r, a lighting signal input i and a common electrode 26. In pixel circuits 5 on odd number lines, the image signal inputs S and the power supply inputs P are connected to SL1 and SL2, respectively. In pixel circuits 5 on even number lines, the image signal inputs S and the power supply inputs P are connected to SL2 and SL1, respectively. The reset signal inputs r are connected to the reset signal lines 6. The lighting signal inputs i are connected to the lighting signal lines 7. The common electrodes 26 of all the pixel circuits 5 are connected to one another and to a ground potential outside.

Figure 2:
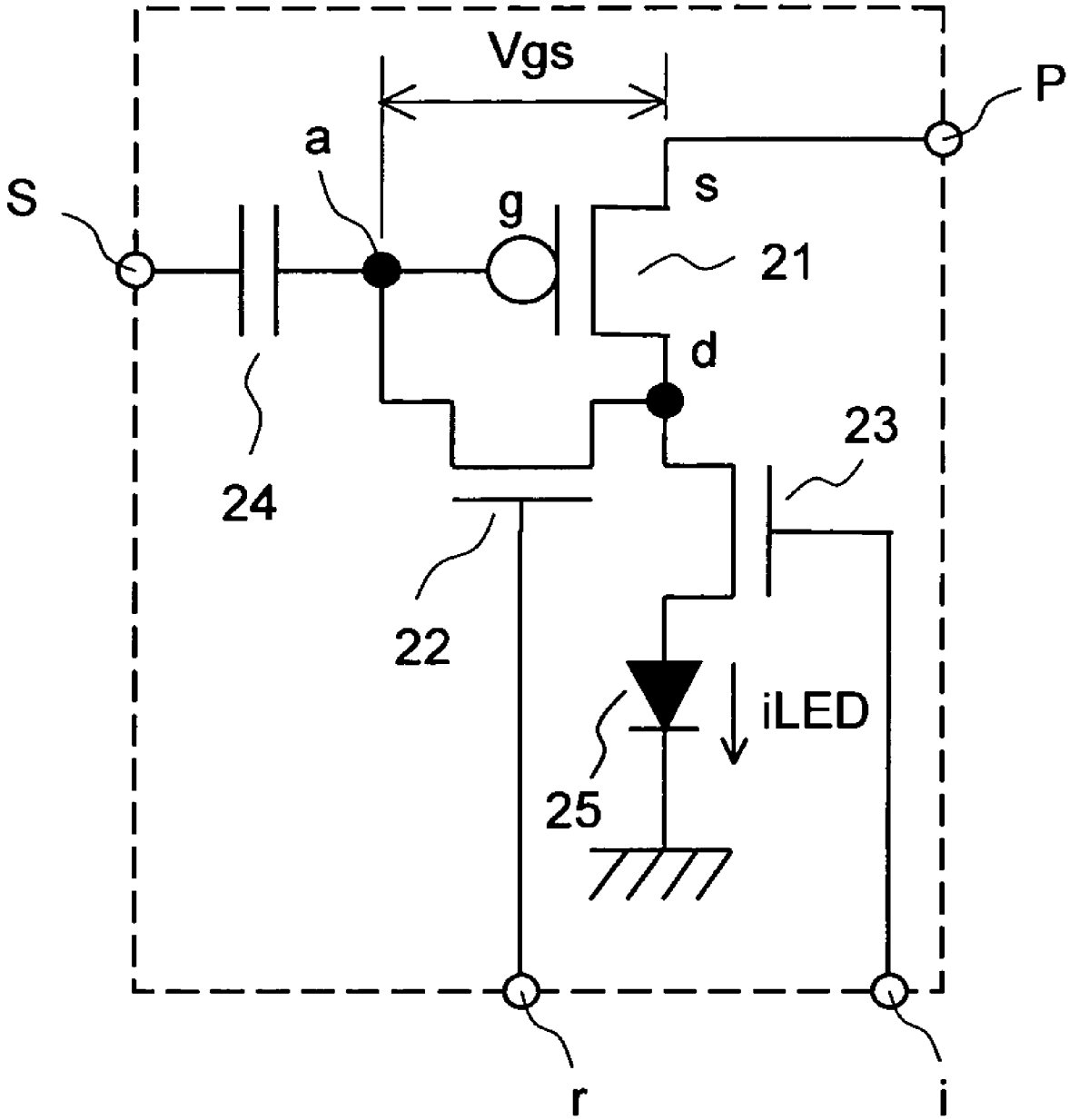
FIG. 2 shows the configuration of each of the pixel circuits shown in FIG. 1.
Figure 3:
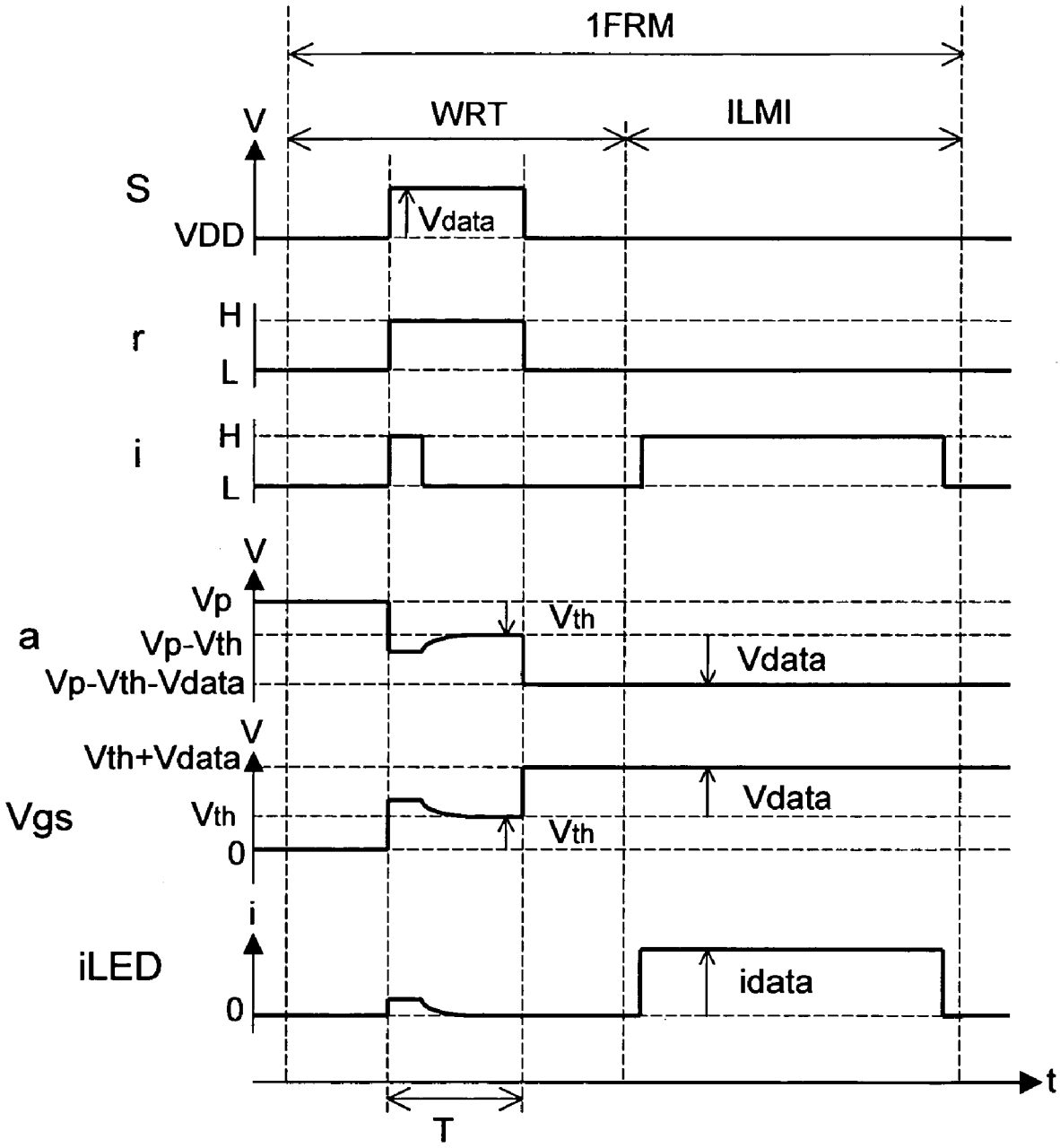
FIG. 3 shows the drive waveform and the internal voltage of the pixel circuit shown in FIG. 1.

FIG. 2 shows the configuration of the pixel circuit 5 and FIG. 3, the drive waveform of the pixel circuit 5 and the internal voltage of the pixel circuit 5. In a one-frame (1FRM) period, the drive waveform is composed of two modes including a write mode (WRT) and a lit mode (ILMI). In the write mode, there are "write times T" during which data are written into prescribed pixel circuits 5. In each write time T, an image signal voltage Vdata to be written into prescribed pixel circuits 5 is supplied to a signal input S. Since the image signal voltage Vdata references a source voltage VDD, the voltage supplied to the signal input S is VDD+Vdata. Synchronized with the supply of the image signal voltage Vdata, a pulse is supplied to the reset signal input r. In the vicinity of the leading edge of a reset pulse, a pulse having a smaller width than the reset pulse is supplied to the lighting signal input i. The power supply input P is supplied with the source voltage VDD in the write time T. In the lit mode, only the lighting signal input i is set to a high (H) level. Further, the signal input S and the power supply input Pare supplied with the source voltage VDD. These drive signals cause the pixel circuits 5 to perform the following operation.

At the beginning of the write time T, since the reset signal input r is at a high (H) level and the lighting signal input i is also at a high level, the TFTs 22 and 23 are turned on (ON), and currents flow into the EL elements 25 via the TFTs 21 and 23.

As a current flows then between the drain d and the source s of the TFT 21, the absolute value Vgs of the gate g/source s voltage of the TFT 21 is a higher voltage than Vth. Vth here represents the absolute value of the threshold voltage of the TFT 21. As the node a is connected to the gate g of the TFT 21, the voltage Va of the node a is a lower voltage than VDD−Vth.

Then, when the lighting signal input i falls to a low (L) level, the TFT 23 is turned off (OFF), and as a result the node a and the EL element 25 are electrically cut off from each other. Where as the voltage of the node a rises as a positive charge is supplied from the power supply input P through the TFT 21, the absolute value Vgs of the gate g/source s voltage of the TFT 21 decreases along with that. Eventually, when Vgs becomes equal to Vth, almost no current flows between the drain d and the source s of the TFT 21 any longer, and the voltage of the node a becomes stable at VDD−Vth. As a signal voltage VDD+Vdata is then applied to the left electrode and the voltage VDD−Vth of the node a to the right electrode of the capacitor 24, a voltage of Vdata+Vth is generated between the electrodes of the capacitor 24.

When the write time T ends, as the reset signal input r falls to a low level, the right electrode of the capacitor 24 is electrically cut off from the node a, and the inter-electrode voltage Vdata+Vth of the capacitor 24 is preserved.

Next in the lit mode ILMI, as the reset signal input r is at a low level, the TFT 22 is OFF, and the capacitor 24 is holding the voltage Vdata+Vth applied in the write mode WRT. Since the capacitor 24 is then holding the voltage Vdata+Vth applied during the write time T, the node a is at a voltage VDD−Vdata−Vth. Since the voltage of the source s of the TFT 21 is the same as the source voltage VDD and the voltage of the gate g is the same as the voltage of the node a, the absolute value of the gate g/source s voltage Vgs=(VDD)−(VDD−Vdata−Vth)=Vth+Vdata. As the lighting signal input i is at a high level, the TFT 23 is ON, and a current iLED flows into the EL element 25 following the gate/source voltage Vgs of the TFT 21. Vgs becomes equal to Vth and the current iLED equal to 0 at the image signal voltage Vdata=0 V. By raising Vdata to above 0 V, the current iLED can be uniformly increased. Therefore, the pixel circuit 5 controls the amperage of the current flowing into the EL element 25 with the image signal voltage Vdata and can thereby regulate the brightness of the EL element 25.

Figure 4:
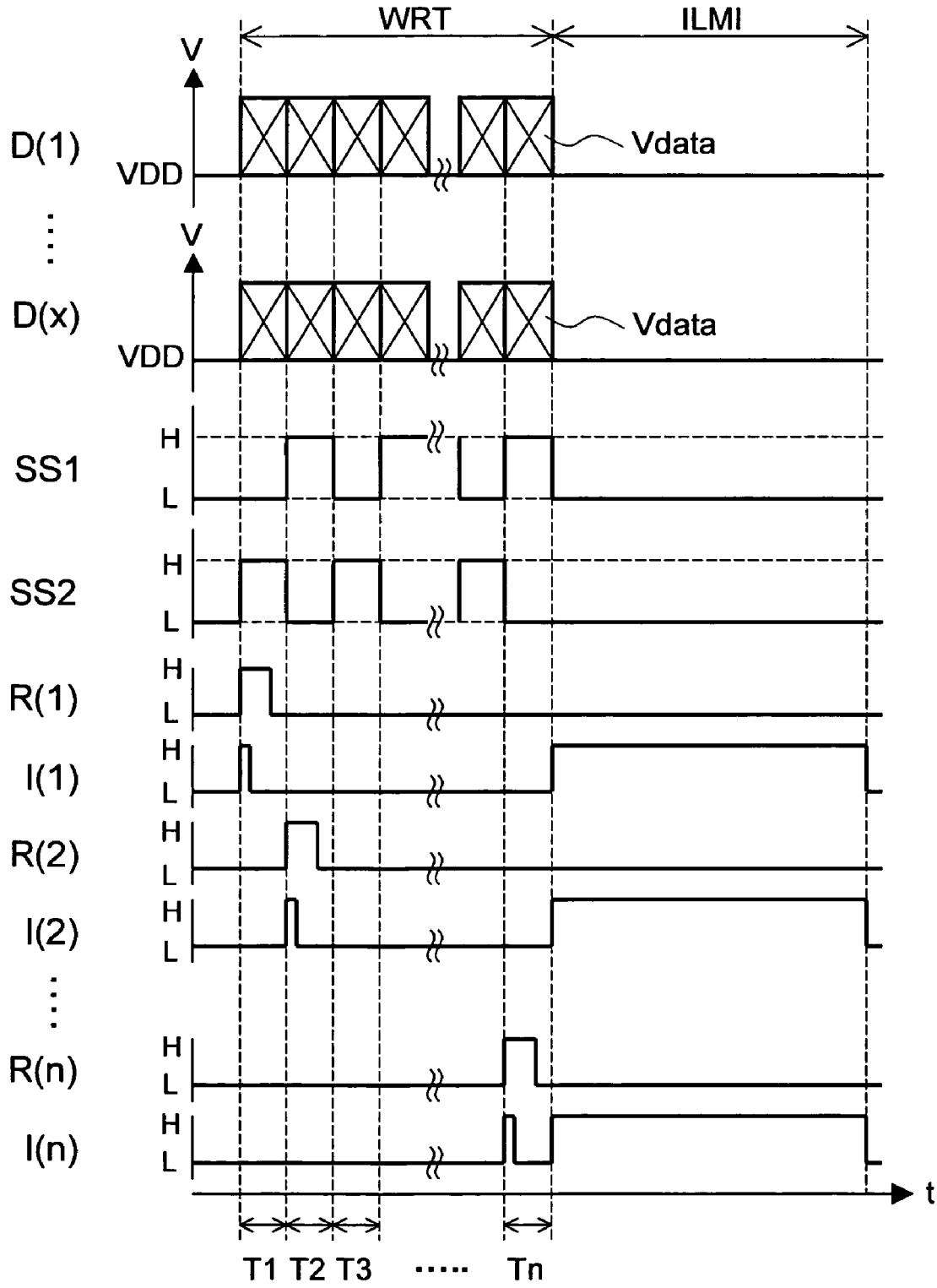
FIG. 4 shows the waveforms generated by the drive circuit and the scanning circuit in the first embodiment of the invention.

As described above, in order to control the pixel circuits 5, the drive circuit 3 and the scanning circuit 4 in this embodiment generate waveforms shown in FIG. 4. In the write mode WRT, the outputs D(1) through D(x) of the driver IC 11 generate the image signal voltage Vdata. T1 through Tn denote the write times T in the pixel circuits 5, and the outputs D(1) through D(x) generate the image signal voltage Vdata in synchronism with T1 through Tn. The switching signal line SS1 of the selection switch circuit 12 rises to a high level during the write time (T2, T4, . . . ) of pixel circuits on even number lines, and the switching signal line SS2 rises to a high level in the write times (T1, T3, . . . ) of pixel circuits on odd number lines. This results in the supplying of the image signal voltage Vdata from the driver IC to the wiring SL1 and the supplying of the power voltage VDDex to the wiring SL2 during the write time of the pixel circuits 5 on odd number lines. During the write times of the pixel circuits on even number lines, the source voltage VDDex is supplied to the wiring SL1 and the image signal voltage Vdata, to the wiring SL2.

The outputs R(1) through R(n) and I(1) through I(n) of the scanning circuit 4 generate pulses at the write times T1 through Tn of the corresponding rows. This causes the pixel circuits 5 on each row to write the voltage Vdata+Vth into the capacitor 24 in the corresponding write periods T1 through Tn.

In the lit mode ILMI, the switching signal lines SS1 and SS2 fall to a low level (L) and the outputs I(1) through I(n) of the scanning circuit 4 rise to a high level (H). Then, the external power voltage VDDex is supplied to both of the wirings SL1 and SL2, and a current is supplied to the power supply input P of every pixel circuit 5. Since the TFT 23 in every pixel circuit 5 is on, every pixel circuit 5 controls the brightness of the EL element 25 in accordance with the voltage stored in the capacitor 24 of each pixel circuit 5. Therefore, the image display device of this embodiment displays an image matching the image signal voltage supplied by the driver IC 11.

Figure 5:
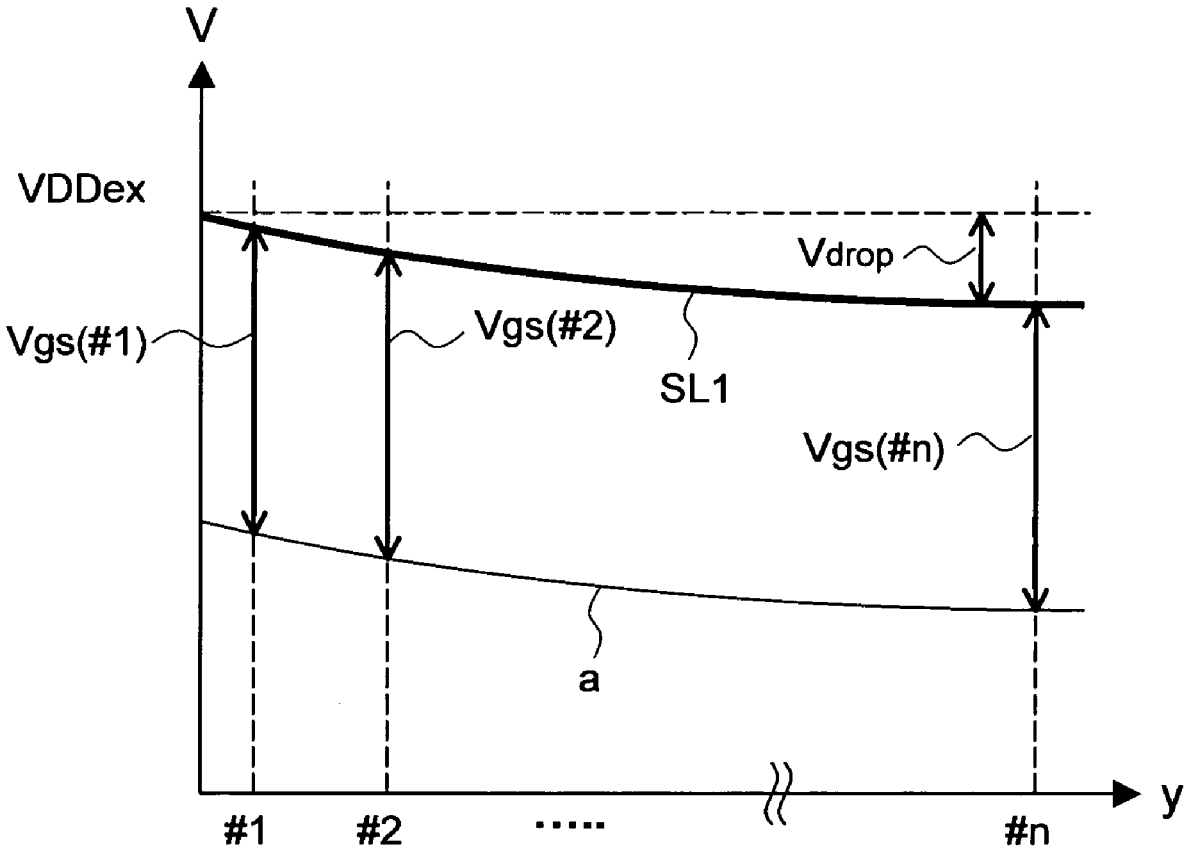
FIG. 5 shows voltage drops on wirings SL1 and SL2, the voltage of a node a in the pixel circuit, and Vgs (#1) through Vgs (#n) of the TFT 21 in the first and second embodiments.

When in image is displayed (lit mode), as the EL element 25 in each pixel circuit 5 is lit, large currents flow to the wiring SL1 and the wiring SL2 shown in FIG. 1. Then the resistances of the wirings SL1 and SL2 cause the voltage to drop. FIG. 5 shows the voltage drop on the wiring SL1, the voltage of the node a in the pixel circuit 5, and the gate/source voltages Vgs (#1) through Vgs (#n) of the TFT 21. The horizontal axis represents the longitudinal direction of the direction (direction y) of the paper surface of FIG. 1 and the vertical axis, the voltage. It has to be noted, though, that FIG. 5 supposes the voltages Vdata to be equal among all the pixel circuits (the image display device to be lit at constant and uniform brightness) for the sake of making the graphic expression easier to understand. Further, as the voltage drop on the wiring SL2 is about equal to that on the wiring SL1, only the wiring SL1 is shown in FIG. 5.

The wiring SL1 is connected to the power supply inputs P of the pixel circuits 5 on even number line, and the wiring SL2, to the power supply inputs P of the pixel circuits 5 on odd number lines. For this reason, when a normal image is displayed, about a half each of the current needed for lighting one row of EL elements 25 flows to the wirings SL1 and SL2. Therefore, compared with an arrangement in which a current is let flow on a single wiring, the voltage drop Vdrop is reduced. Furthermore, about equal voltage drops Vdrop occur on the wirings SL1 and SL2, and the voltages on the wirings SL1 and SL2 become equal if the position of the direction y is unchanged. As a result, the voltage of the power supply input P and that of the signal input S of each pixel circuit 5 will be the same, namely VDD=VDDex−Vdrop. The absolute value of the gate/source voltage of the TFT 21 then will be Vgs=(VDDex−Vdrop)−(VDDex−Vdrop−Vdata−Vth)=Vth+Vdata, and unaffected by any voltage drop Vdrop.

Therefore, it is made possible to control currents flowing into the EL elements 25 without being affected by any voltage drop on the wiring and to control the brightness of the EL elements 25. Since the brightness of the EL elements is unaffected by any voltage drop on the wiring, poor image quality, such as smear shown in FIG. 15, can hardly occur.

Figure 6:
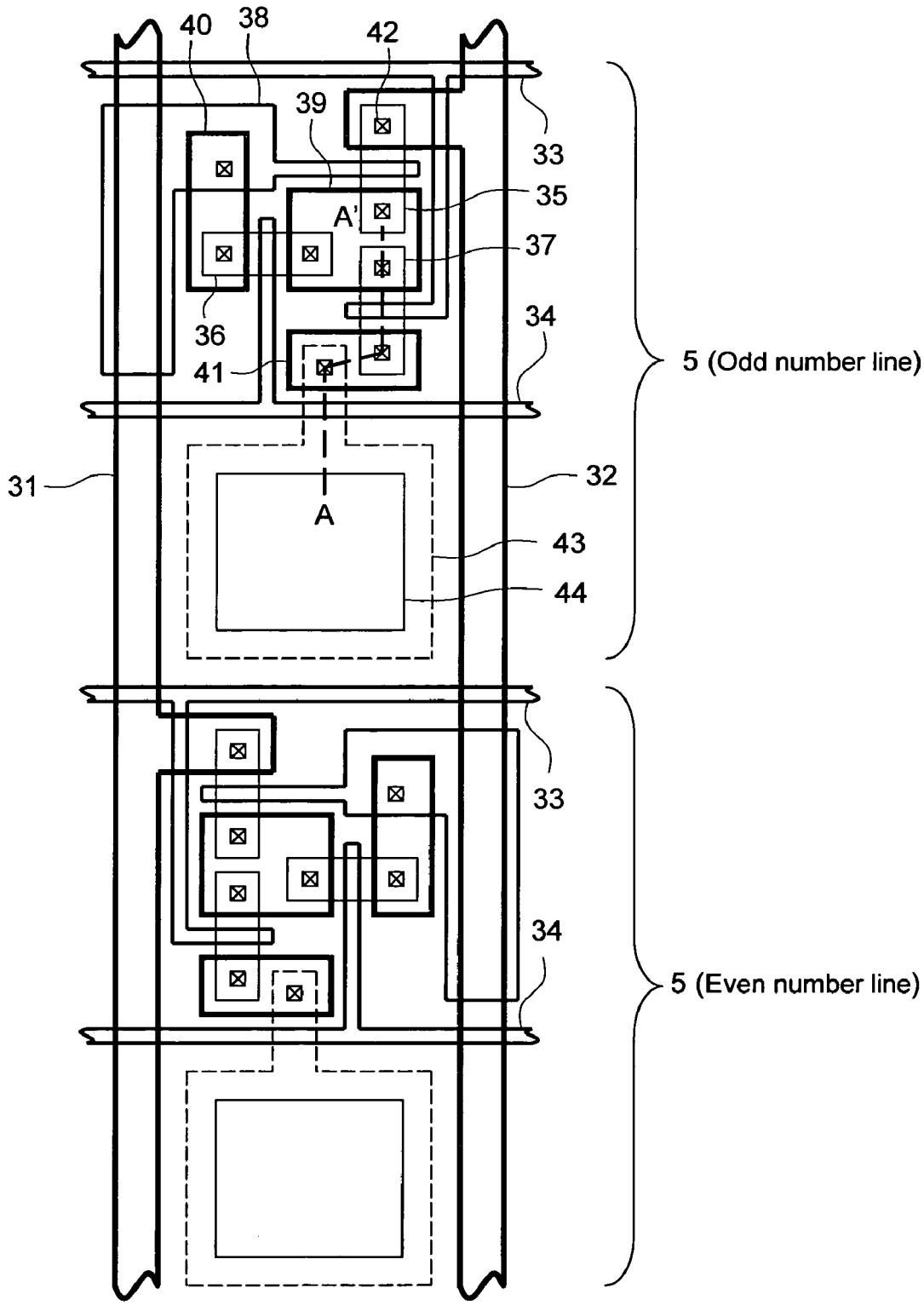
FIG. 6 shows a first layout of the pixel circuits formed over the glass substrate of the first embodiment.

FIG. 6 shows a first layout of the pixel circuits 5 formed over the glass substrate 1. The wirings SL1 and SL2 are formed of a first layer of metal film wirings 31 and 32. The lighting signal lines 7 and the reset signal lines 6 are formed of a second layer of metal film wirings 33 and 34. The TFT 21 is formed in the overlapping part of a polysilicon film 35 and of a second layer of metal film wiring 38, the TFT 22, in that of a polysilicon film 36 and of the second layer of metal film wiring 34, and the TFT 23, in that of a polysilicon film 37 and of the second layer of metal film wiring 33. The capacitor 24 is formed in the overlapping part of the second layer of metal film wiring 38 and the first layer of metal film wirings 31 and 32. Metal wiring layers 39 through 41 are intended for connection between different layers. A plurality of contact holes 42 connect different layers overlapping each other. An organic EL layer is formed over an electroconductive transparent film 43, and is electrically connected in an area covering an opening 44. Over an organic EL light-emitting layer, a third layer of metal film is vapor-deposited in an area covering all the pixel circuits to form the common electrode 26. As the pixel circuits 5 on odd number lines and those on even number lines are laid out symmetrically between right and left, the image signal inputs S and the power supply inputs P in the pixel circuits 5 on odd number lines are connected to the wirings SL1 and SL2, respectively. Also, the image signal inputs S and the power supply inputs P in the pixel circuits 5 on even number line are connected to the wirings SL2 and SL1, respectively.

Figure 7:
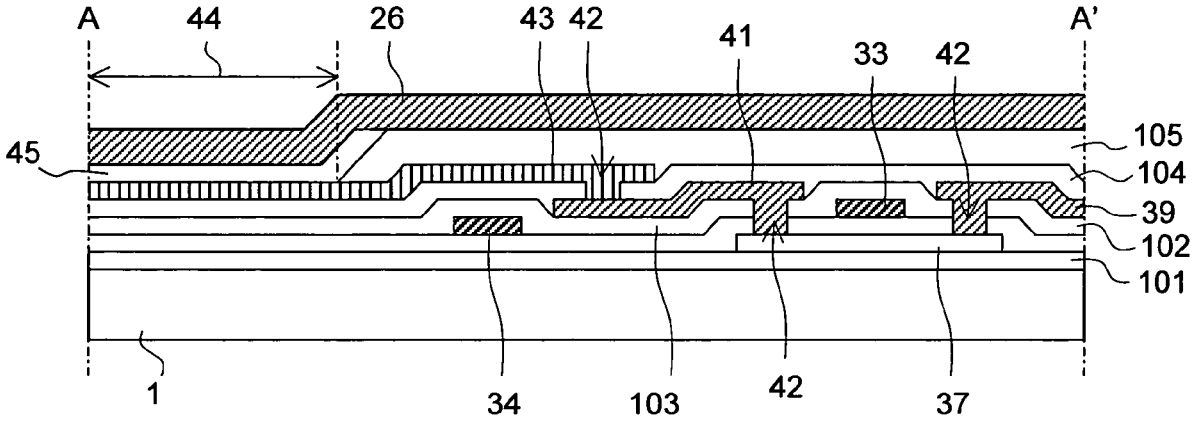
FIG. 7 shows a partial section along line A-A' shown in FIG. 6.

A sectional structure of the part along line A-A' in FIG. 6 is shown in FIG. 7. An insulator film 101 is formed over the glass substrate 1, and the polysilicon film 37 is formed over it. Further over it, the second layer of metal film wirings 33 and 34 is formed with an insulator film 102 between them. Further over it, the first layer of metal film wirings 39 and 41 are formed with an insulator film 103 between them. Further over it, the electroconductive transparent film 43 is formed with an insulator film 104 between them. Further over it, an insulator film 105 is formed. An opening in the insulator film 105 constitutes the opening 44, and in its vicinity an organic EL layer 45 is vapor-deposited. Further over it, a third layer of metal film wiring is vapor-deposited to constitute the common electrode 26. The contact holes 42 are bored into an insulator film to keep the metal film wiring and the electroconductive transparent film in contact. When a current flows between the electroconductive transparent film 43 and the common electrode 26 through the opening 44, the organic EL layer 45 emits light. The light emission can be observed through the glass substrate 1 in the upward direction from underneath the surface of the drawing. With reference to FIG. 7, layers relevant to luminescence characteristics including an electron transport layer and a hole transport layer are supposed to be described collectively with respect to the organic EL layer 45.

Figure 8:
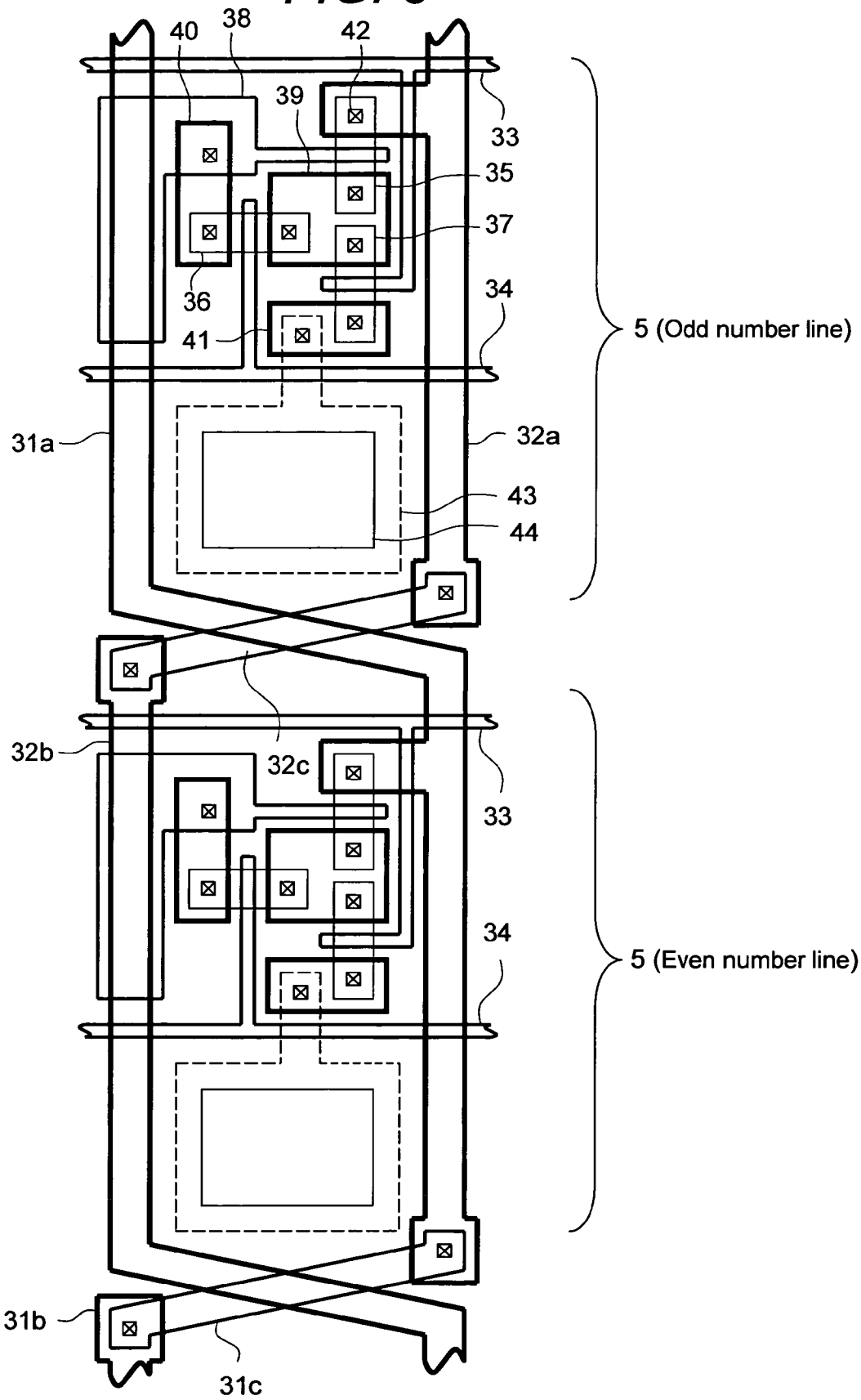
FIG. 8 shows a second layout of the pixel circuits formed over the glass substrate of the first embodiment.

FIG. 8 shows a second layout of the pixel circuits 5 formed over the glass substrate 1. The configurations of the first layer of metal film wirings 39, 40 and 41, the second layer of metal film wirings 33, 34 and 38, the polysilicon films 35, 36 and 37, the contact holes 42, the electroconductive transparent film 43, the opening 44, the organic EL light-emitting layer and the third layer of metal film wirings are the same as their respective counterparts in FIG. 6. The wiring SL1 is formed of the first layer of metal film wirings 31*a* and 31*b* and the second layer of metal film wirings 31*c*; the wiring SL2 is formed of the first layer of metal film wirings 32*a* and 32*b* and the second layer of metal film wirings 32*c*; and the wirings SL1 and SL2 cross each other between pixel circuits, namely in a twist pair structure. The second layout has an advantage of using the same layout for pixel circuits on odd number lines and pixel circuits on even number lines.

Second Embodiment

Figure 9:
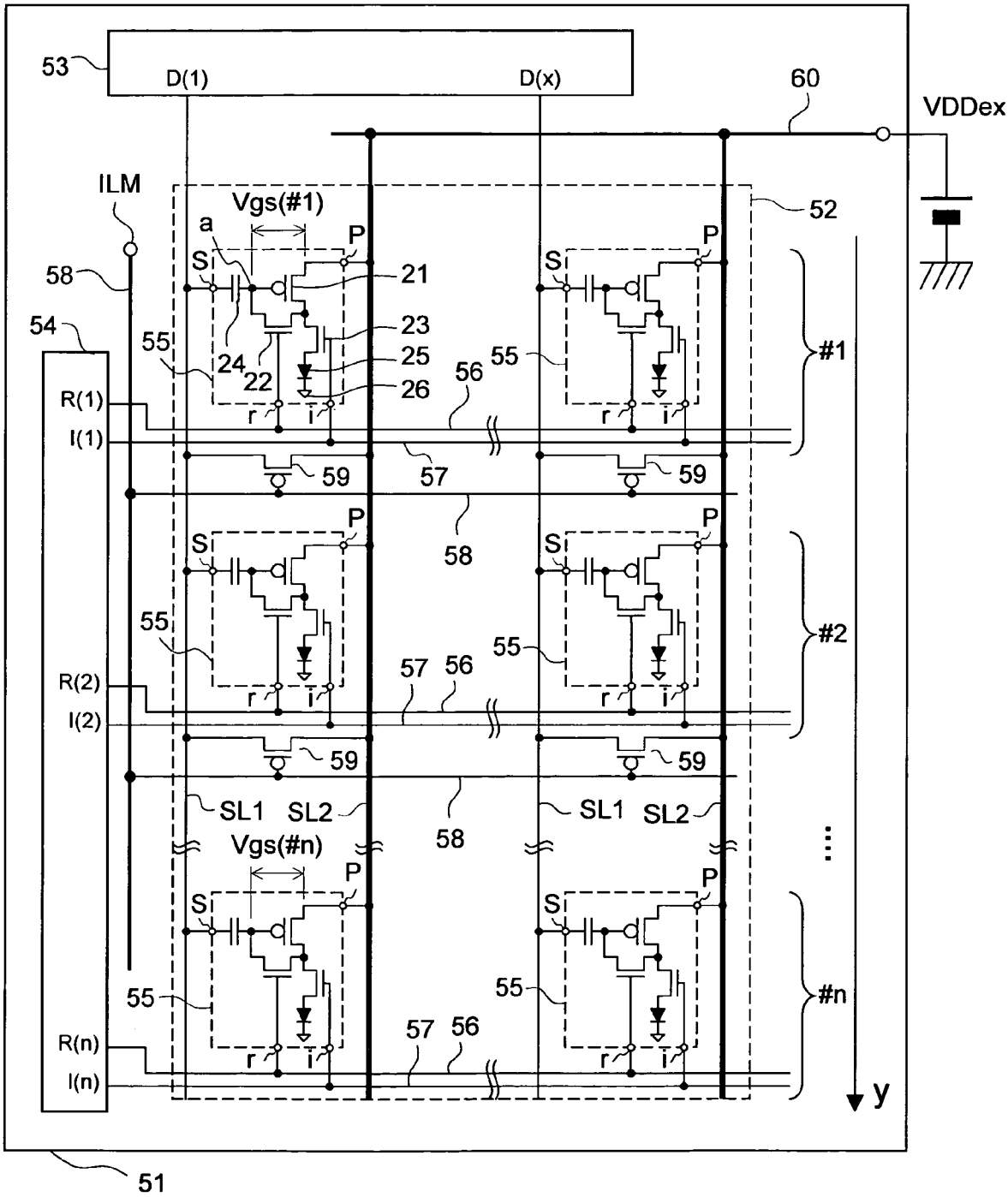
FIG. 9 shows the configuration of an image display device, which is a second preferred embodiment of the invention.

FIG. 9 shows the configuration of an image display device, which is a second preferred embodiment of the invention. An image display area 52 and a scanning circuit 54 are formed over the surface of a glass substrate 51. In the image display area 52, a plurality of pixel circuits 55, a plurality of reset signal lines 56, a plurality of lighting signal lines 57 and the wirings SL1 and SL2 are arranged in a matrix form. The reset signal lines 56 are connected to the reset signal inputs r of the pixel circuits 55 for one row and the lighting signal lines 57, to the lighting signal inputs i of the pixel circuits 55 for one row. The reset signal lines 56 and the lighting signal lines 57 serve to convey the output signals of the scanning circuit 54 to the pixel circuits 55 for one row. The wiring SL1 is connected to the image signal inputs S of the pixel circuits 55 for one column, and the wiring SL2 to the power supply inputs P of the pixel circuits 55 for one column. It is only for the convenience of description that the number of the pixel circuits 55 is supposed to be 2 columns×3 rows=6, those of the reset signal lines and lighting signal lines, three each, and those of the wirings SL1 and SL2, two each. If the resolution of the screen conforms to that of color VGA for instance, the number of columns and that of rows of the pixel circuits 55 will be 1920 and 480, respectively, and those of the reset signal lines 56 and the lighting signal lines 57 will be 480, and those of the wirings SL1 and SL2 will be 1920 each. A driver IC 53 is stuck onto the glass substrate 51 by pressure bonding. The driver IC 53 has a function to convert digital image signals serially received from outside into voltage signals and supply them to the outputs D(1) through D(x).

A power supply bus 60, connected to all the wirings SL2, supplies the power voltage VDDex received from outside to the wirings SL2. The scanning circuit 54, which is a logic circuit formed of a TFT, has a function to drive every one of the reset signal lines 56 and the lighting signal lines 57. A plurality of P-channel TFTs 59 are arranged between the pixel circuits 55. The drain and source of each TFT 59 are respectively connected to the wiring SL1 and the wiring SL2. The gate of every TFT 59 is connected to a signal line 58, and has a function to convey a signal ILM received from outside to the gate electrode of every TFT 59.

The circuit configuration of the pixel circuits 55 is the same as what is shown in FIG. 2, namely the configuration of the pixel circuits 5 shown with respect to the first embodiment. For this reason, the drive waveform and the internal voltage of the pixel circuits 55 are as shown in FIG. 3, namely those of the pixel circuits 5 shown with respect to the first embodiment.

Figure 10:
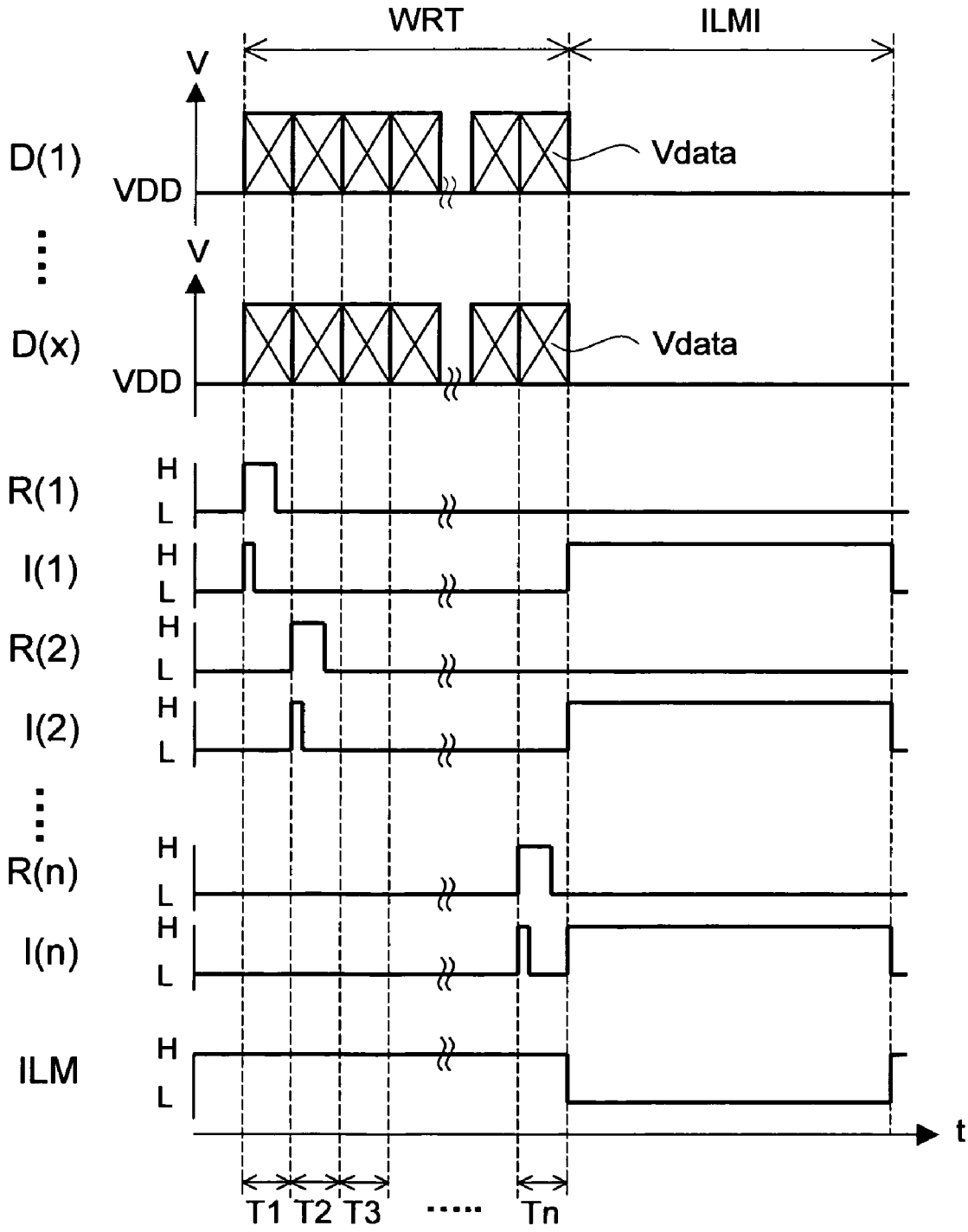
FIG. 10 shows the waveforms generated by the driver IC and the scanning circuit of the second embodiment and the waveform of a signal.

In order to control the pixel circuits 55, the driver IC 53 and the scanning circuit 54 of this embodiment generate waveforms shown in FIG. 10. The signal ILM shown in FIG. 10 is supplied to the wiring 58. In the write mode WRT, the outputs D(1) through D(x) of the driver IC 11 generate an image signal voltage Vdata and supplies it to the plurality of wirings SL1. T1 through Tn denote the write times T in the pixel circuits 55 on different rows, and the outputs D(1) through D(x) generate the image signal voltage Vdata in synchronism with T1 through Tn. The outputs R(1) through R(n) and I(1) through R(n) of the scanning circuit 54 generate pulses in the write times T1 through Tn of the respectively corresponding rows. This causes the pixel circuit 55 on different rows to write the voltage Vdata+Vth into the capacitor 24 in the corresponding write periods T1 through Tn. Since the signal ILM is at a high (H) level, the TFT 59 is OFF, and the wirings SL1 and SL2 are electrically cut off from each other. In the lit mode ILMI, the outputs I(1) through I(n) of the scanning circuit are set to a high level, and the signal ILM, to a low (L) level. As the TFT 23 of every pixel circuit 55 is ON, every pixel circuit 55 controls the brightness of the EL element 25 in accordance with the voltage stored in the capacitor 24 of each pixel circuit. Further, since the TFT 59 is ON, the wirings SL1 and SL2 enter into a state in which the parts to which the TFT 59 is connected are electrically connected, so that currents are supplied to the EL elements 25 through both of the wirings SL1 and SL2.

When an image is displayed (lit mode), as the EL element 25 in each of the pixel circuits 55 is lit, large currents flow to the wiring SL1 and the wiring SL2 shown in FIG. 9. Then the resistances of the wirings SL1 and SL2 cause the voltage to drop, and if Vdata is equal among all the pixel circuits 55 as in the first embodiment, the same characteristics as what are shown in FIG. 5 will be obtained. The voltage drops on the wiring SL1 and the wiring SL2, the voltage of the node a in each of the pixel circuits 55 connected to them, and the gate/source voltage Vgs of the TFT 21 manifest similar characteristics to their respective counterparts in the first embodiment.

As the wiring SL2 is connected to the power supply inputs P of the pixel circuits 55, a current to light the EL elements 25 flows on the wiring SL2. As stated above, since the wirings SL1 and SL2 are electrically connected by the TFT 59 in the lit mode ILMI, a current of substantially the same amperage flows on the wiring SL1, too. Thus, about a half each of the current needed for lighting one row of EL elements 25 flows to the wirings SL1 and SL2. Therefore, compared with an arrangement in which a current is made to flow on a single wiring as in the conventional configuration, the voltage drop Vdrop is reduced. Furthermore, about equal voltage drops Vdrop occur on the wirings SL1 and SL2, and the voltages on the wirings SL1 and SL2 become equal if the position of the direction y (the longitudinal direction of the drawing in FIG. 9) is unchanged. As a result, the voltage of the power supply input P and that of the signal input S of each pixel circuit 55 will be the same, namely VDD=VDDex−Vdrop. The absolute value of the gate/source voltage of the TFT 21 then will be Vgs=(VDDex−Vdrop)−(VDDex−Vdrop−Vdata−Vth)=Vth+Vdata, and unaffected by any voltage drop Vdrop. Therefore, it is also possible by the configuration of this embodiment to control currents flowing into the EL elements 25 without being affected by any voltage drop on the wiring and to control the brightness of the EL elements 25.

Figure 15:
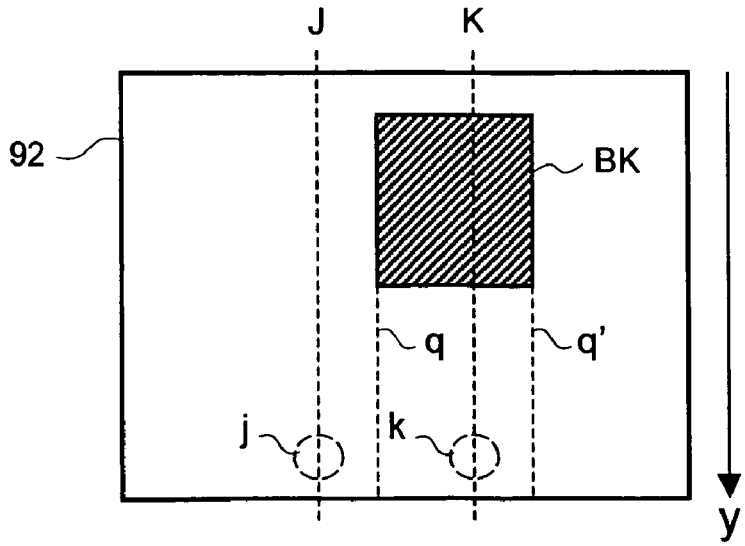
FIG. 15 PRIOR ART
FIG. 15 illustrates poor image quality (smear) due to a voltage drop on the power supply line.

Since the brightness of the EL elements is unaffected by any voltage drop on the wiring, poor image quality, such as smear shown in FIG. 15, can hardly occur.

Figure 11:
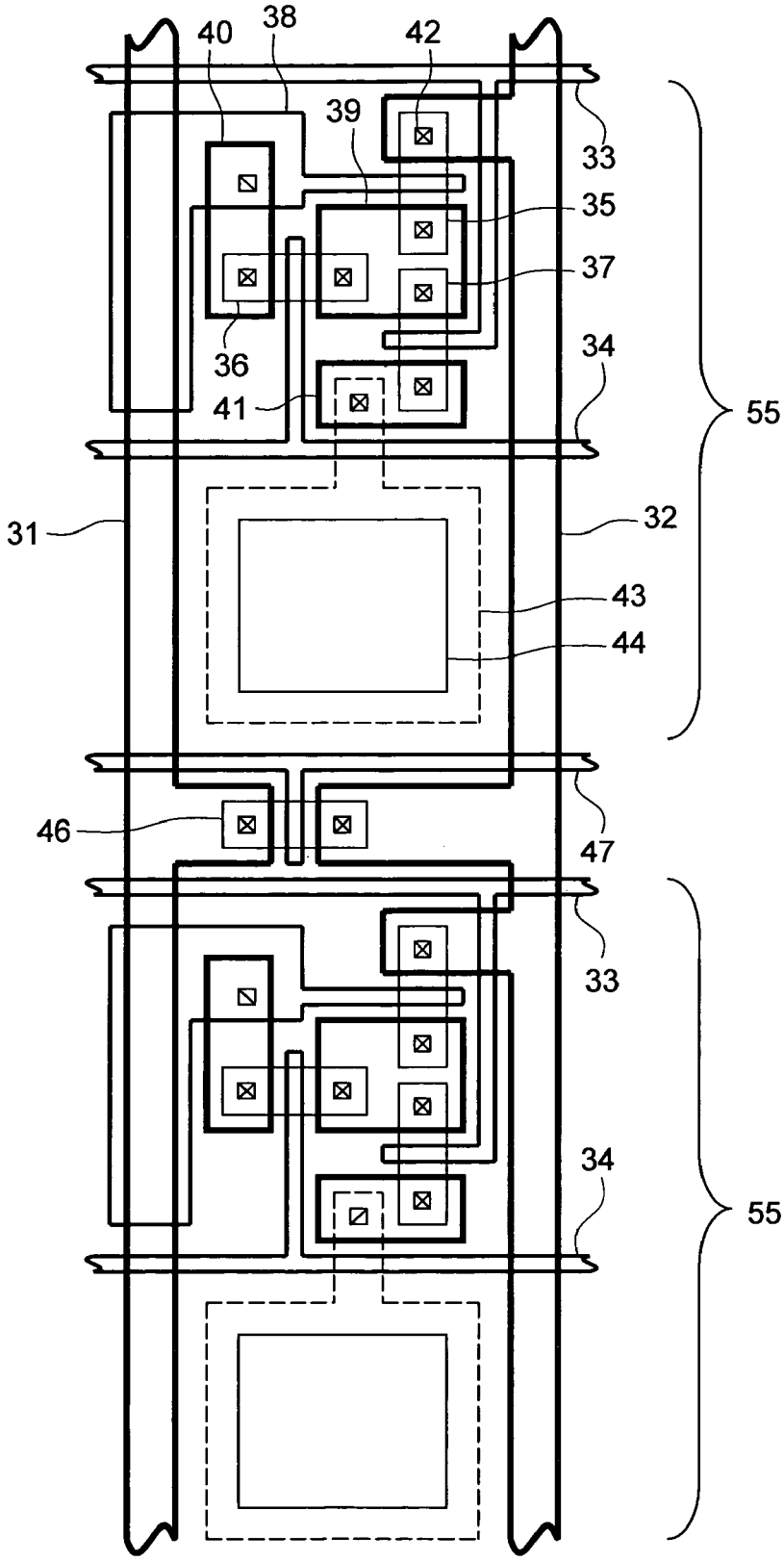
FIG. 11 shows the layout of the pixel circuit formed over the glass substrate of the second embodiment.

FIG. 11 shows the layout of the pixel circuits 55 formed over the glass substrate 51. The configurations of the first layer of metal film wirings 39, 40 and 41, the second layer of metal film wirings 33, 34 and 38, the polysilicon films 35, 36 and 37, the contact holes 42, the electroconductive transparent film 43, the opening 44, the organic EL light-emitting layer and the third layer of metal film wirings are the same as their respective counterparts in the first embodiment shown in FIG. 6. The wiring SL1 is formed of the first layer of metal film wirings 31, and the wiring SL2, of the first layer of metal film wirings 32. The wiring 58 is formed of the second layer of metal film wirings 47, and the TFT 59 to which the wirings SL1 and SL2 are connected is formed in the overlapping part of the polysilicon film 46 and the second layer of metal film wirings 47.

Figure 12:
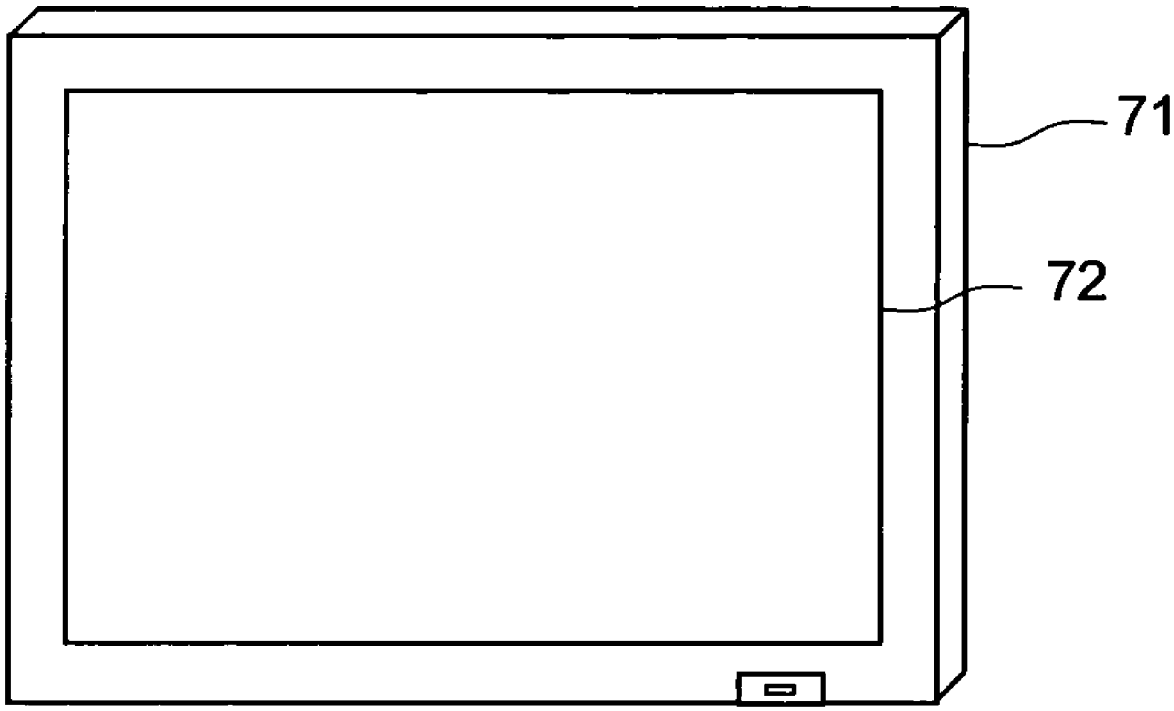
FIG. 12 shows the structure of a television set or an image monitor to which either the first or the second embodiment is applied.
Figure 13:
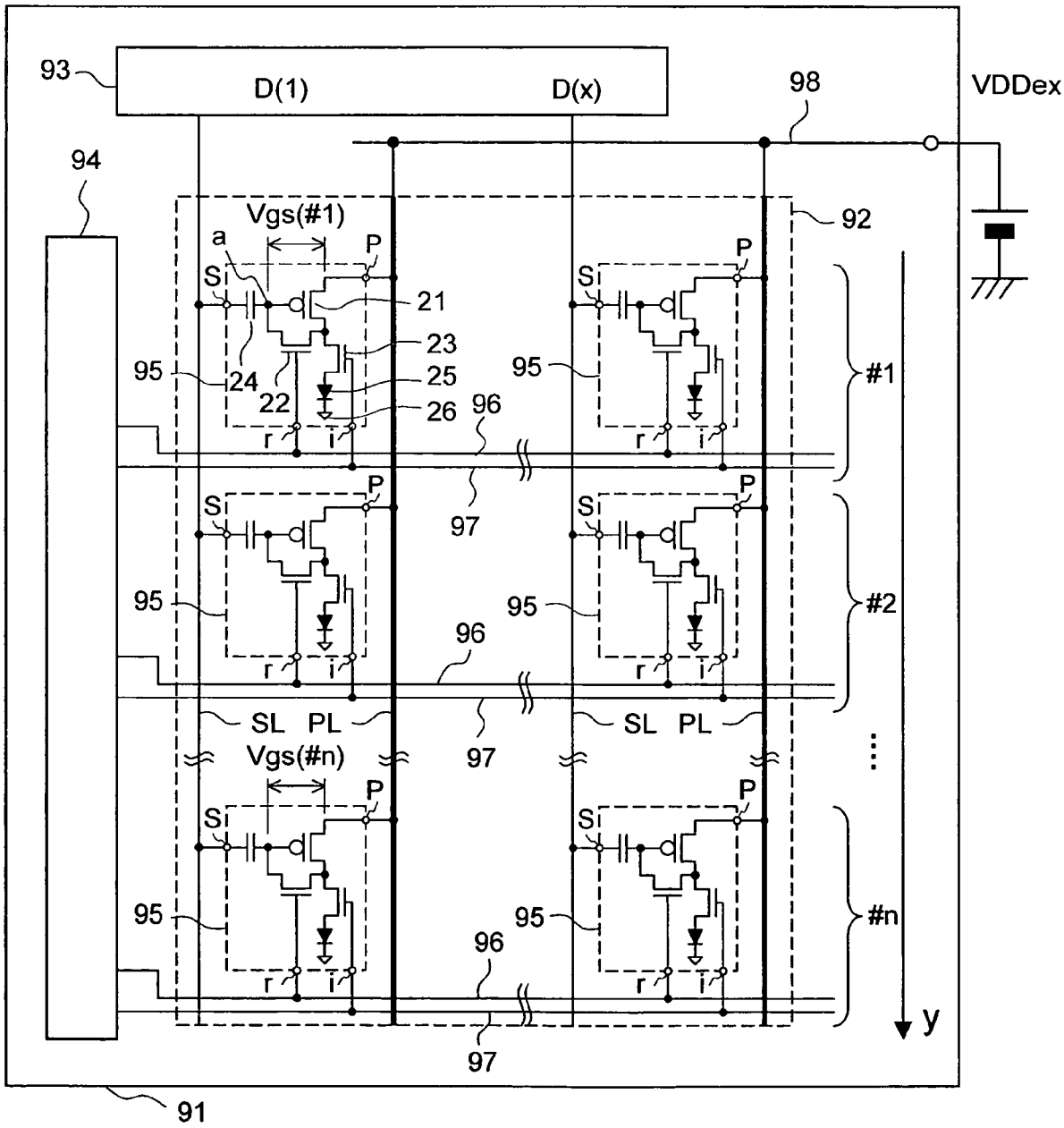
FIG. 13 PRIOR ART
FIG. 13 shows the configuration of a conventional image display device using EL elements.
Figure 14:
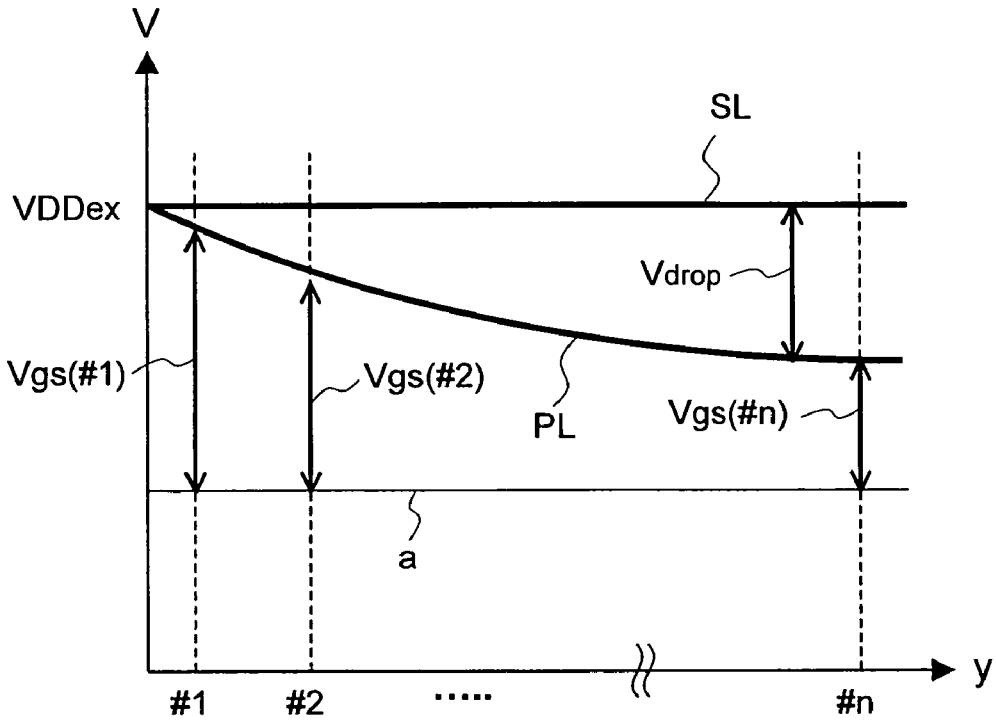
FIG. 14 PRIOR ART
FIG. 14 shows the voltages on the power supply line PL and the signal line SL, the voltage of the node a in the pixel circuit, and the gate/source voltages Vgs (#1) through Vgs (#n) of the TFT 21 in the conventional image display device.

FIG. 12 shows the structure of a television set or an image monitor to which either the first or the second embodiment is applied. Within a frame 71, an image display device 72 of the configuration of either the first or second embodiment is mounted. The television set or image monitor of FIG. 12 can display high quality TV images or PC screens because it is substantially free from poor image quality, such as smear, due to voltage drops on the wiring. Where the image display device of FIG. 12 is large, wiring resistance is greater, resulting in greater voltage drops. However, since the brightness of EL elements is less susceptible to the influence of voltage drops on the wiring than in conventional display devices, the configuration according to the invention is particularly effective for large television sets or image monitors.

According to the present invention, since the brightness of EL elements is hardly affected by the influence of voltage drops on the power supply wiring, poor image quality such as smear cannot easily occur. Moreover, the invention would enable a television set or an image monitor to display images of high quality. It can prove particularly effective for large television sets or image monitors which could be more susceptible to voltage drops on the wiring.

What is claimed is:

1. An image display device in which a plurality of pixel circuits each comprising a capacitor, a first transistor, a second transistor, a third transistor and an EL element are arranged in a matrix form over a substrate, further comprising:

a scanning circuit for controlling the operation of said plurality of pixel circuits;

a plurality of scanning wirings for conveying signals of said scanning circuit to said plurality of pixel circuits;

a plurality of first wirings and a plurality of second wirings for supplying image signal voltages and power voltages to said plurality of pixel circuits, arranged in parallel to each other and crossing said scanning wirings;

a drive circuit for supplying image signal voltages to said first wirings and said second wirings, and selection switch circuits, wherein:

a gate of the first transistor in the pixel circuit on an odd row of the matrix is connected to one of the first wirings, one end of the EL element in the pixel circuit on the odd row of the matrix is connected to one of the second wirings through source-drain paths of the first transistor and the second transistor, the other end of the EL element in the pixel circuit on the odd row of the matrix is connected to a common electrode, one end of EL element in the pixel circuit on an even row of the matrix is connected to one of the first wirings through source-drain paths of the first transistor and the second transistor, the other end of the EL element in the pixel circuit on the even row of the matrix is connected to the common electrode, a source-drain path of the third transistor is connected between the gate of the first transistor and the drain of the first transistor, the image signal voltage is supplied to the first wiring and held in the capacitor of the pixel circuit on the odd row of the matrix, and the power voltage is supplied to the second wiring through one of the selection switch circuits during a first write time, the image signal voltage is supplied to the second wiring and held in the capacitor of the pixel circuit on the even row of the matrix, and the power voltage is supplied to the first wiring though one of the selection switch circuits during a second write time, and the power voltages are supplied to the first wiring and the second wiring and the second transistors are on in the lit mode.

2. The image display device according to claim 1, wherein said first wirings and said second wirings are formed in a twist pair structure.

3. The image display device according to claim 1, wherein the first transistors, the second transistors and the third transistors of said pixel circuits are formed of a thin film transistor.

* * * * *

UNITED STATES PATENT AND TRADEMARK OFFICE

CERTIFICATE OF CORRECTION

PATENT NO. : 7,652,647 B2
APPLICATION NO. : 11/242039
DATED : January 26, 2010
INVENTOR(S) : Kageyama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1149 days.

Signed and Sealed this

Twenty-third Day of November, 2010

David J. Kappos

David J. Kappos
*Director of the United States Patent and Trademark Office*